US006478073B1

(12) United States Patent
Grebe et al.

(10) Patent No.: US 6,478,073 B1
(45) Date of Patent: Nov. 12, 2002

(54) COMPOSITE CORE FOR CASTING METALLIC OBJECTS

(75) Inventors: David E. Grebe, Fond du Lac, WI (US); Mark P. Potratz, Fond du Lac, WI (US); William G. Hesterberg, Rosendale, WI (US); Terrance M. Cleary, Fond du Lac, WI (US)

(73) Assignee: Brunswick Corporation, Lake Forest ( * ) Notice: Subject to any disclaimer, the term of this patent is extended or adjusted under 35 U.S.C. 154(b) by 0 days.

(21) Appl. No.: 09/833,772

(22) Filed: Apr. 12, 2001

(51) Int. Cl.[7] ..... B22C 9/10; B22D 29/00
(52) U.S. Cl. ..... 164/28; 164/132; 164/369
(58) Field of Search ..... 164/369, 370, 164/28, 30, 132, 228, 340

(56) References Cited

U.S. PATENT DOCUMENTS

| | | | | |
|---|---|---|---|---|
| 3,963,818 A | | 6/1976 | Sakoda et al. | 264/56 |
| 4,252,175 A | | 2/1981 | Whipple | 164/9 |
| 4,361,181 A | | 11/1982 | Wischnack et al. | 164/552 |
| 4,421,153 A | * | 12/1983 | Wilkinson et al. | 164/35 |
| 4,586,553 A | | 5/1986 | Allen et al. | 164/30 |
| 4,743,481 A | | 5/1988 | Quinlan et al. | 428/36 |
| 4,840,219 A | | 6/1989 | Foreman | 164/369 |
| 4,875,517 A | | 10/1989 | Donahue et al. | 164/34 |
| 4,904,423 A | | 2/1990 | Foreman et al. | 264/25 |
| 4,922,863 A | | 5/1990 | Adams | 123/52 |
| 4,922,991 A | * | 5/1990 | Pitcher et al. | 164/36 |
| 5,166,464 A | | 11/1992 | Donahue et al. | 164/113 |
| 5,303,761 A | | 4/1994 | Flessner et al. | 164/15 |
| 5,803,151 A | | 9/1998 | Carden | 164/5 |

FOREIGN PATENT DOCUMENTS

| | | |
|---|---|---|
| JP | 63-252661 | * 10/1988 |
| JP | 63642 | * 3/1990 |

* cited by examiner

*Primary Examiner*—Kuang Y. Lin
(74) *Attorney, Agent, or Firm*—William D. Lanyi

(57) ABSTRACT

A composite core structure is used for metal casting in order to form cavities of preselected sizes and shapes within the casting. The composite core has an insoluble support member that can be metallic and a soluble portion disposed around at least a part of the support member. When the composite core is used in a casting process, such as a die casting process, the soluble portion is dissolved after the casting process is complete, and the insoluble portion is then removed from the cavity that was formed through the use of the composite core.

18 Claims, 7 Drawing Sheets

COMPOSITE CORE FOR CASTING METALLIC OBJECTS

BACKGROUND OF THE INVENTION

1. Field of the Invention

The present invention is generally related to cores used in the casting process to provide cavities in a cast metallic object and, more particularly, to a composite core that comprises both soluble and insoluble portions.

2. Description of the Prior Art

Those skilled in the metal casting process, and particularly the high pressure die casting processes, are well aware that cavities in cast metal objects are often provided by using a soluble core that is inserted into a mold prior to causing a molten metal to flow into the mold. The soluble core, which is typically made of a salt compound, reserves space in the mold as the liquid metal flows around it and, after the molten metal has solidified, the soluble core can be dissolved to leave a cavity of the desired shape and size. The soluble cores are typically made of a salt compound and can be removed from the solidified metal casting by causing water or another liquid to flow in contact with the soluble core. This liquid dissolves the salt core, leaving a cavity having a size and internal surface configuration generally identical to the outer surface configuration of the salt core prior to the casting process.

U.S. Pat. No. 4,586,553, which issued to Allen et al on May 6, 1986, describes a process for pressure casting a piston with a crown insert and a cavity. The crown is placed in the mold before casting and the soluble salt core forms a cavity in the piston. The salt core is held by a crown insert to position the salt core in the mold to prevent the salt core from moving during the pressure casting procedure.

U.S. Pat. No. 5,803,151, which issued to Carden on Sep. 8, 1998, describes a soluble core method for manufacturing metal cast products. The improved soluble core for die casting metals or metal matrix composites is formed of a mixture of salt and up to about 20 weight % of ceramic material blended together to produce a homogeneous mixture and compacted under pressure to product a soluble core having little or no porosity. The ceramic material can be in the form of fibers, particulates, whiskers, and/or platelets, and has a melting temperature greater than that of the salt.

U.S. Pat. No. 3,963,818, which issued to Sakoda et al on Jun. 15, 1976, describes a water soluble core for pressure die casting and process for making the same. The process includes pre-drying a granular water soluble salt having grain size of less than about 1000 microns so that the moisture content thereof becomes less than 1%. It also comprises the step of molding under pressure the granular water soluble salt into a desired shape and volume at a pressure of between about 1.5 to 4 tons per square centimeter and, if necessary, sintering the molded salt at a temperature of between about 100°–300° C. The core for pressure die casting acts as a cavity former within a casting and substantially consists of a water soluble salt having a compressive strength of between about 800–1480 kg per square centimeter, a bending strength of between about 200–370 kg per square centimeter, and a density of between 2.05–2.12.

U.S. Pat. No. 4,252,175, which issued to Whipple on Feb. 24, 1981, describes a cylinder block having a cast in core unit and a process for manufacturing the same. A core unit for use in casting a cylinder block of an internal combustion engine which core unit comprises a preformed cylinder liner which includes a cylindrical sidewall defining an interior bore and having a port in the sidewall is disclosed. A first core unit is formed of a reducible material molded upon the preformed liner, which first core unit includes a first main core portion which partially occupies the bore and a port core portion which extends through the port. A second core unit is formed of the reducible material separately from the first core unit and is assembled upon the cylinder liner, which second core unit includes a second main core portion in the bore and in mating alignment with the first main core portion, thereby forming a composite core assemblage.

U.S. Pat. No. 4,361,181, which issued to Wischnack et al on Nov. 30, 1982, describes a casting core and process for the production thereof. A casting core for the creation of difficultly accessible cavities in castings of aluminum or of one of its alloys, is produced from a water soluble salt as base substance and burnt sugar as a binding agent, and a process for the production of such a casting core wherein the base substance is mixed with burnt sugar in aqueous or organic solution, pressed into molds, and baked at elevated temperature.

U.S. Pat. No. 4,743,481, which issued to Quinlan et al on May 10, 1988, describes a molding process for articles having an irregular shaped internal passage. The process for making an article having an irregular internal passage utilizes a hollow polymer preform. The preform is filled with a relatively incompressible filler material such as a powder or a fluid, which supports the preform when it is placed in a mold, such as an injection mold. The filler enables the preform to withstand high molding pressures and prevents deflection and movement of the internal passage within the preform. The shell, a layer of a polymer material is then molded about the preform. After the final article has been formed, consisting of the preform and the shell, the filler is removed for possible reuse.

U.S. Pat. No. 4,840,219, which issued to Foreman on Jun. 20, 1989, describes a mixture and method for preparing casting cores and cores prepared thereby. Casting cores are fabricated from a mixture comprising a molten salt having dispersed therein a particulate material which includes a first refractory material having a mesh size of 60–120 and a second refractory material having a mesh size of at least 200. The salts are preferably halides, carbonates, sulfates, sulfites, nitrates or nitrites of Group Ia and Group IIa metals and the refractory material may be selected so as to be non-reactive with the molten salt. Some preferred refractory materials include alumina and magnesium silicate.

U.S. Pat. No. 4,922,863, which issued to Adams on May 8, 1990, describes a cast engine cylinder having an internal passageway and method of making same. A cast cylinder for an internal combustion engine having an intake valve cavity located on one side of the piston bore, an intake bore for communication with a carburetor located on the other side of the piston bore, and an internal passageway cast there in communicating the intake bore and the intake valve cavity is disclosed. The internal passageway is curved and circumscribes a portion of the intake bore. A walled hollow tube having initially closed ends is embedded in the cast cylinder during casting as a permanently retained casting core. Subsequently, the ends of the embedded tube are machined open to communicate with the intake valve cavity and the intake bore, respectively, to define the internal passageway.

U.S. Pat. No. 4,904,423, which issued to Foreman et al on Feb. 27, 1990, describes a pressure molding process using salt cores and composition for making cores. The process for pressure molding an article around a hardened salt mold core made from a mixture of relatively low melting temperature salt and sand, wherein the core is removed from the finished article by immersion of the article containing the core into a molten bath mixture of the core material to thereby melt the core out of the article, is disclosed. The process also recovers the core material and thus replenishes the bath for use in making additional cores. The bath is originally constituted by melting a suitable quantity of a dry premix of the salt and sand.

U.S. Pat. No. 5,303,761, which issued to Flessner et al on Apr. 19, 1994, describes a die casting process using casting salt cores. A process of providing a disposable core for use in die casting processes is described. A salt material is molten and cast into a core of a desired configuration under exacting conditions. The fluidity of the molten salt is controlled enabling casting the salt material into a core by die casting methods. The die casting method provides a core with a high surface finish and strength. The core is evenly cooled subsequent to it being cast and is maintained at an elevated temperature to maintain its surface finish and structural integrity. The cast core is inserted into the dies of a metal die casting machine to facilitate casting a metal product having internal forms not otherwise attainable. The core is removed from the metal product by simply dissolving and flushing the core out of the casting. The salt material may be reclaimed by a de-salination process for further use.

U.S. Pat. No. 4,875,517, which issued to Donahue et al on Oct. 24, 1989, discloses a method for producing salt cores for use in die casting. A pattern, identically proportional in configuration to the salt core to be produced, is initially formed from an evaporable foam material. The evaporable foam pattern is positioned in a mold and surrounded with an unbonded flowable material, such as sand. The pattern is contacted with a molten salt and the high temperature of the salt will vaporize the pattern, with the vapor being captured within the interstices of the sand while the molten salt will fill the void by vaporization of the foam to provide a salt core identical in configuration to the pattern. The salt core is subsequently used in a high pressure die casting operation to cast a metal part.

U.S. Pat. No. 5,165,464, which issued to Donahue et al on Nov. 24, 1992, discloses a method of casting hypereutectic aluminum-silicon alloys using a salt core. A method of high pressure casting of hypereutectic aluminum-silicon alloys using a salt core to form wear resistant articles, such as engine blocks is disclosed. To produce an engine block, one or more solid salt cores are positioned within a metal mold with the space between the cores and the mold defining a die cavity. A molten hypereutectic aluminum-silicon alloy containing more than 12% silicon is fed into the die cavity and on solidification of the molten alloy, precipitated silicon crystals are formed, which are distributed throughout the wall thickness of the cast part and also on the surface bordering the salt cores which constitute the cylinder bores in the cast block. The salt cores are subsequently removed from the cast block by contact with a solvent such as water.

The patents described above are hereby expressly incorporated by reference in the description of the present invention.

The use of soluble cores, such as those made of salt and other soluble materials, have been used in the casting industry for many years. Numerous ways are known to those skilled in the art for manufacturing soluble cores for these purposes. Molten salt can be injected into dies to form the salt cores. Lost foam casting processes can be used to form the salt cores. Other conventional casting processes, along with pressing technologies, are available to those skilled in the art for the manufacture of soluble cores that are used to provide cavities in finished cast metal objects.

Existing technology known to those skilled in the art for manufacturing and using salt cores has several inherent characteristics that can be improved. First, the salt often solidifies in a manner that forms cracks on the surface of the core. These cracks, during the injection molding process during which liquid metal is injected. into a cavity surrounding the core, can fill with metal. As a result, the metal that solidifies within the cracks of the salt core require a salvage operation for their removal. Secondly, large cross sectional areas of the expendable core significantly increase the cycle time during manufacture. This increased cycle time relates not only to the manufacture of the cores themselves, but also to the time required to dissolve the soluble material, such as salt, after the metal casting process is complete. Thirdly, positional issues arise when the expendable core is located in a steel casting die used to make a high pressure die casting, normally of aluminum. It is often difficult to precisely locate the salt core within the steel casting die prior to injecting liquid metal into the die during the high pressure die casting process. Finally, the core material has an associated raw material cost that is proportional to the core volume. This raw material cost, relating directly to the amount of salt used, is incorporated in the cost of the final cast metal object.

It would therefore be significantly beneficial to the metal casting process if a core could be provided which reduces the likelihood of cracking on the surface of the core, reduces the heavy cross sectional areas of the soluble material, allows the expendable core to be more accurately positioned within the steel casting die used during the high pressure die casting process, and reduce the total raw material cost of salt used in the process.

SUMMARY OF THE INVENTION

A composite core made in accordance with a preferred embodiment of the present invention for use in casting an object comprises a soluble portion of the composite core having an outer surface shaped to form an internal surface of a cavity in a metal object and a insoluble support member. The soluble portion is formed around at least a portion of the insoluble support member.

In a particularly preferred embodiment of the present invention, the insoluble support member is made of metal, such as aluminum, and a distal end of the insoluble support member extends out of the soluble portion to expose the distal end. This allows the distal end to be used for purposes of positioning the composite core within a steel casting die, or mold, prior to injection of molten metal. The insoluble support member comprises a base portion from which a metallic strut portion extends. The base portion is shaped to be held by the mold prior to the injection of molten metal.

Throughout the description of the present invention, the metallic strut will be alternatively referred to as a support strut, a locating strut, or a metallic strut. These terms are used because the strut is generally metallic in a most preferred embodiment, provides an important support function for the salt core, and has a distal end that serves an important locating function as will be described in greater detail below.

The present invention provides a method for casting an object which comprises the steps of providing an insoluble support member, forming a soluble portion around at least a portion of the insoluble support member, and providing a shaped outer surface of the soluble portion to be generally identical to a cavity in a metallic object to be cast. The method further comprises extending a distal end of the insoluble support member out of the soluble portion and disposing the insoluble support member, with the soluble portion formed around at least a portion of the insoluble support member, in a mold having an internal surface which is shaped to form the metallic object. The soluble portion is disposed at a location within the mold to create the cavity in the metallic object.

The method further comprises the steps of causing a liquid metal to flow into the mold and around the insoluble support member with the soluble portion formed around at least a portion of the insoluble support member, allowing the liquid metal to solidify, removing the metallic object from the mold with the soluble portion formed around at least a portion of the insoluble support member remaining in place within the solidified metallic object, dissolving the soluble portion, and removing the insoluble support member from the cavity of the metallic object. The distal end of the insoluble support member is disposed in contact with an internal surface of the mold to determine a position of the soluble portion within the mold.

BRIEF DESCRIPTION OF THE DRAWINGS

The present invention will be more fully and completely understood from a reading of the description of the preferred embodiment of the present invention, in conjunction with the drawings, in which.

DESCRIPTION OF THE PREFERRED EMBODIMENT

Figure 1:
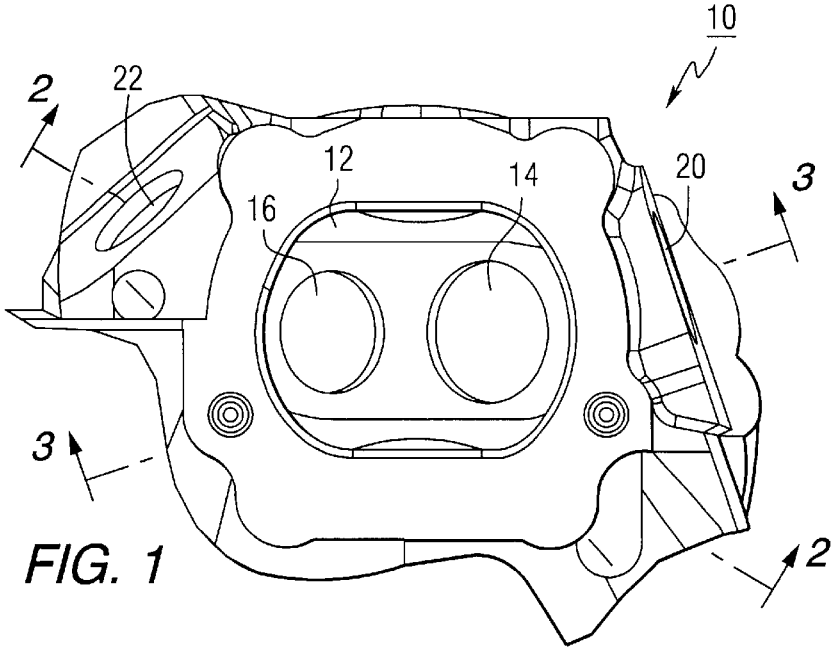
FIG. 1 shows a cylinder head that is manufacturable through the use of the present invention.

Throughout the description of the preferred embodiment of the present invention, like components will be identified by like reference numerals.

FIG. 1 shows a portion of a cylinder head 10 with a combustion chamber 12 having an intake port 14 and an exhaust port 16 connected in fluid communication with the combustion chamber 12. Also shown in FIG. 1 is an intake passage 20 and an exhaust passage 22.

Figure 2:
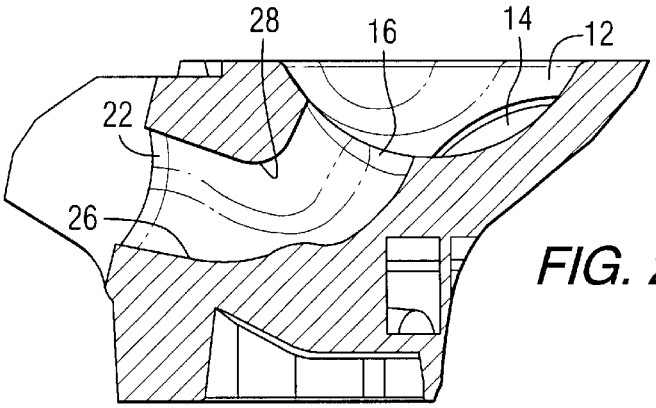
FIGS. 2 and 3 are section views of FIG. 1.

FIG. 2 is a section view of FIG. 1 taken through the exhaust port 16 and exhaust passage 22. It can be seen that the exhaust passage 22 is complex in shape with an irregular surface 26 and a thinned width portion 28 near the mid portion of its length.

Figure 3:
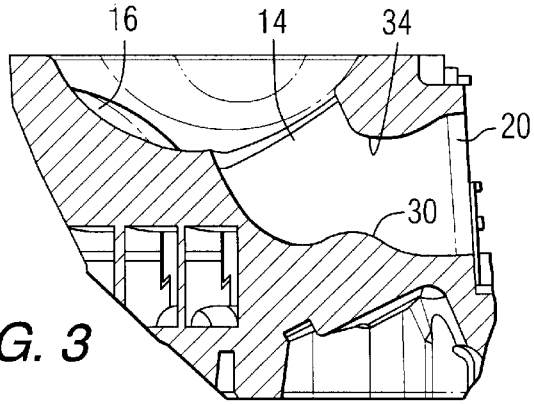

FIG. 3 is a section view of FIG. 1 through the intake port 14 and the intake passage 20. It can be seen in FIG. 3 that the internal surface 30 of the intake passage 22 is significantly irregular and has a thinned width portion 34 approximately midway along its length.

With reference to FIGS. 2 and 3, it can be seen that the cavity defining the intake passage 22 provides a difficult cavity shape if the cylinder head 10 is to be manufactured by the injection molding process. Cavities in injection molded objects, such as a cylinder head 10, are typically provided by inserting a soluble core, such as one made of salt, into a steel die or mold and then injecting molten metal, such as aluminum, into the cavity of the die and around the soluble core. This process is well known to those skilled in the art as described above. However, when a cavity, such as the intake passage 20 or exhaust passage 22 has a highly irregular shape with thinned central portions, providing suitable soluble cores is difficult. The thinnest sections of the width are subject to fracture. The present invention, as will be described in detail below, provides a solution to this problem.

Figure 4:
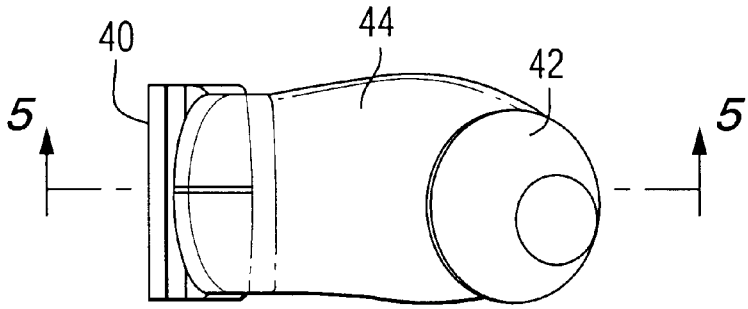
FIGS. 4, 5, and 6 are views of a salt core that could be used to manufacture the cylinder head of FIG. 1 according to methods known to those skilled in the art.

If the intake passage 20 is formed through the use of a salt core, according to methods known in the prior art, the salt core would resemble the component shown in FIG. 4. One end 40 would extend out from the injection cavity of the mold and the opposite end 42, or distal end, would extend into the cavity of the mold at the location where the air inlet 14 is to be formed. The central portion of the component shown in FIG. 4, which is identified by reference numeral 44, is shaped to define the internal surface 30 of the intake passage 20.

Figure 5:
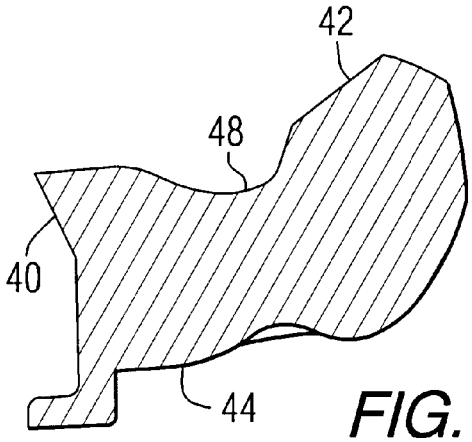

FIG. 5 is a sectional view of FIG. 4 showing the significantly thinned portion 48 of the component that represents the thinned portion 34 of the intake passage 20 described above in conjunction with FIG. 3.

Figure 6:
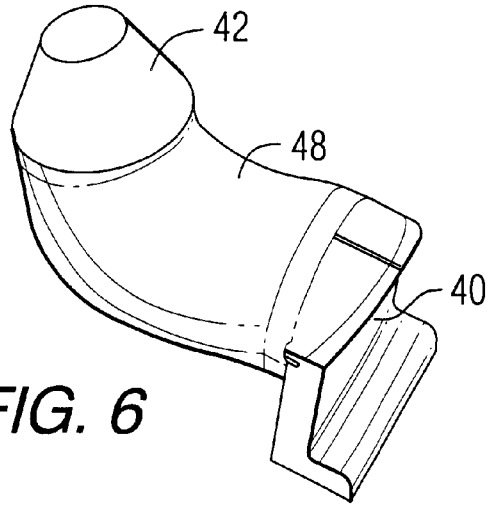

FIG. 6 is an isometric view of the salt core shown in FIGS. 4 and 5. With reference to FIGS. 4–6, it can be seen that the salt core represented in these figures exhibits several possible disadvantages. First, the central portion 48 has a significantly thinned section that may be susceptible to breakage during handling of the salt core. In addition, when the core is inserted into a die, into which molten metal will be injected, the distal end 42 of the salt core can not be precisely located relative to the cavity into which it is inserted. The dimensional accuracy of the salt surface of the core can not be relied upon to precisely define a location that can be used for accurately positioning the core. The base end 40 can be attached to the steel die and rigidly held in place in an attempt to accurately position all of the surface of the salt core, but the opposite end 42 can not be used with confidence for these purposes. In addition, since the entire volume of the component is salt, material costs are maximized and surface cracking is possible.

Figure 7:
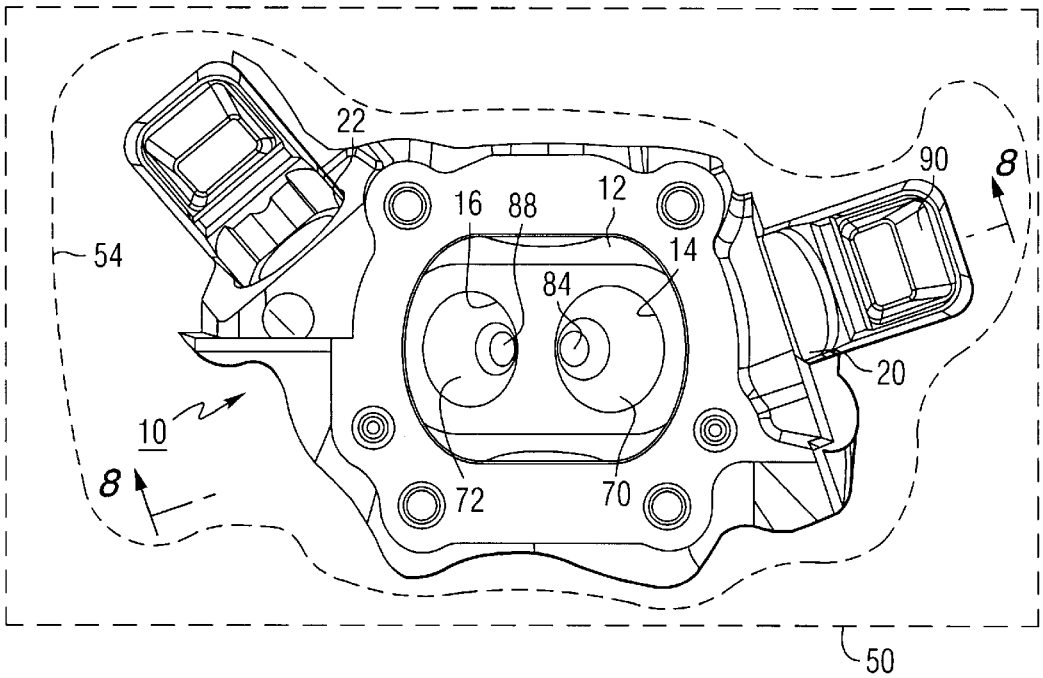
FIG. 7 shows the cylinder head of FIG. 1 in a die with composite cores of the present invention in place.

FIG. 7 shows the cylinder head 10, which was described above in conjunction with FIG. 1, with two composite cores made in accordance with the present invention dispose within its intake and exhaust passages, 20 and 22. The cylinder head 10 is also shown in a dashed box 50 that represents a steel die used to cast the cylinder head 10 by the injection molding process. The die 50 is cut away, as represented by dashed line 54, to expose the cylinder head 10. It should be understood that the outer surface of the cylinder head 10 is not relevant to the concepts or scope of the present invention. The present invention is directly related to the use of composite cores to facilitate the casting process in relation to cavities in the metal object, such as the intake passage 20 and exhaust passage 22.

In FIG. 7, a soluble portion 70 of one composite core is provided with an outer surface that is shaped to define the inner surface 30 of the intake passage 20 described above in conjunction with FIG. 3. The other composite die is provided with a soluble portion 72 with an outer surface that is shaped to define the inner surface 26 of the exhaust passage 22 described above in conjunction with FIG. 2. As will be described in greater detail below, an insoluble support member is disposed in the center portion of the composite core, with the soluble portion being formed around at least a portion of the insoluble support member. The present invention, and its use of a metallic strut, significantly reduces the amount of salt used during each casting procedure. This reduction in salt usage not only reduces the overall cost of the casting process, but is more beneficial for the environment.

Figure 8:
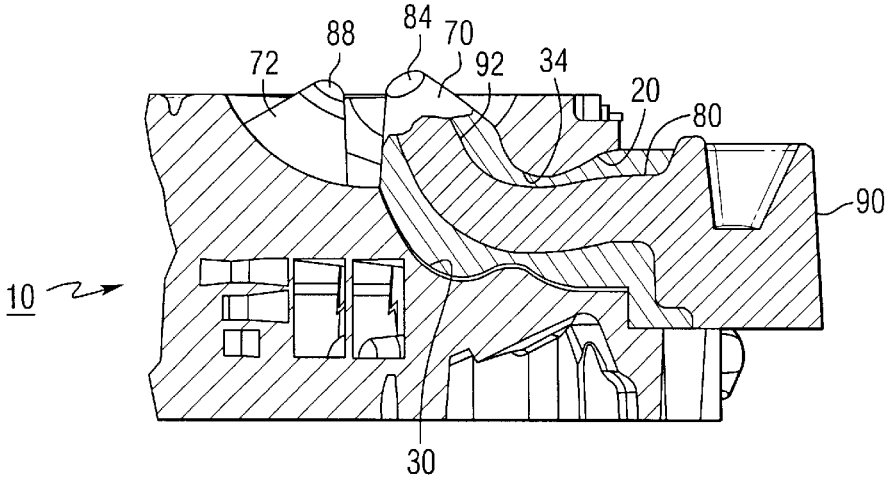
FIG. 8 is a section view of FIG. 7.

FIG. 8 is a section view of FIG. 7, particularly taken through the composite core inserted into the intake passage 20 of the cylinder head 10. An insoluble support member 80, made of a material such as a metal, has the soluble portion 70 formed around at least a portion of the insoluble support member. In a particularly preferred embodiment of the present invention, the insoluble support member 80 is made of aluminum. A distal end 84 of the insoluble support member 80 extends out of the soluble portion 70 to expose the distal end 84. In the other composite core shown in FIGS. 7 and 8, the distal end is identified by reference numeral 88.

In FIG. 8, it can be seen that the insoluble support member 80 extends through the central region of the composite core and provides improved strength for the total composite core structure. This is particularly important in the mid region 34 of the intake passage 20 where the composite core is of a reduced thickness.

With continued reference to FIG. 8, it can be seen that the insoluble support member 80 is provided with a base portion 90 and a metallic strut 92 extending from the base portion 90. The base portion 90 is shaped to be attachable to the steel die 50 used to mold the cylinder head 10, as illustrated in FIG. 7. It should be understood that FIGS. 7 and 8 show the finished cylinder head 10 with the composite cores remaining in place. After the die casting process is complete and the molten aluminum has solidified, the finished metal object, such as the cylinder head 10, is removed from the die 50 and the soluble portion 70 of the composite core is dissolved through the use of a suitable liquid, such as water. Subsequent to dissolving the soluble portion 70, the insoluble support member 80 is removed from the intake passageway 20 and another insoluble support member is recovered from the exhaust passageway 22.

Figure 9:
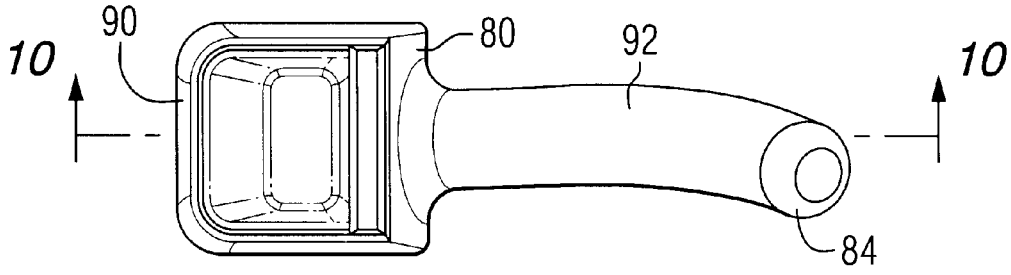
FIGS. 9, 10, and 11 are views of an insoluble support member used in conjunction with the present invention.
Figure 10:
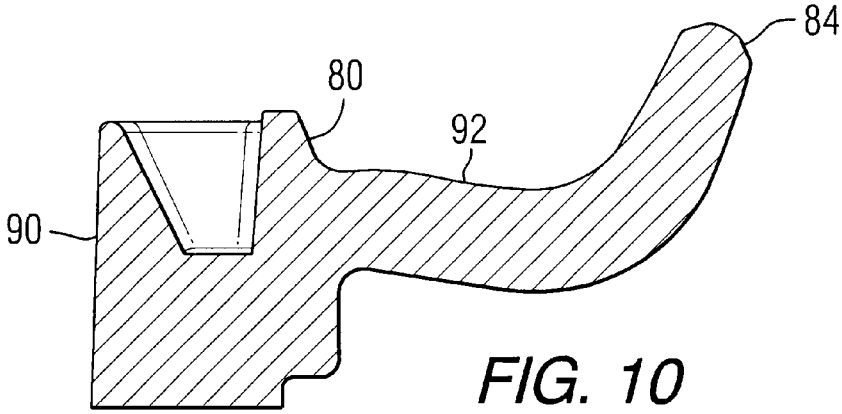

FIG. 9 is a top view of the insoluble support member 80 with its base portion 90 and the metallic strut 92 extending from the base portion. FIG. 10 is a section view of FIG. 9.

Figure 11:
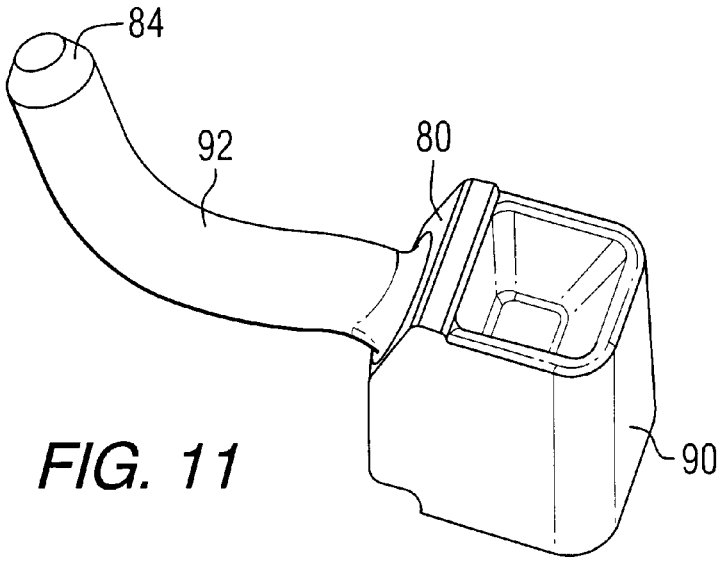

FIG. 11 is an isometric view of the insoluble support member 80 showing the locating strut 92, or locating strut, extending from the base portion 90 and having a distal end 84.

Figure 12:
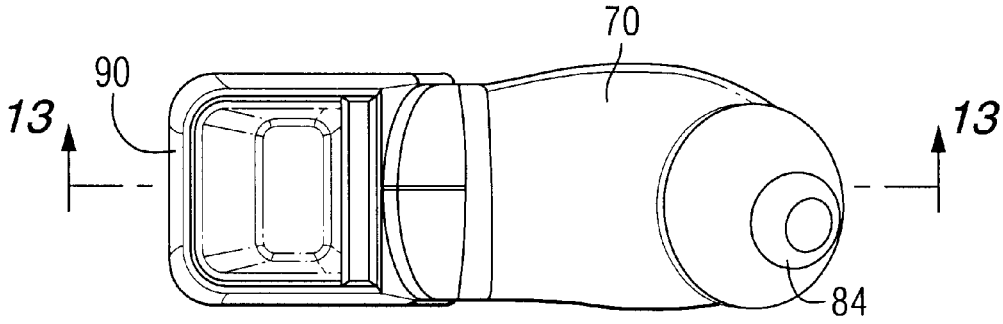
FIGS. 12, 13, and 14 are views of a composite core made in accordance with the present invention.
Figure 13:
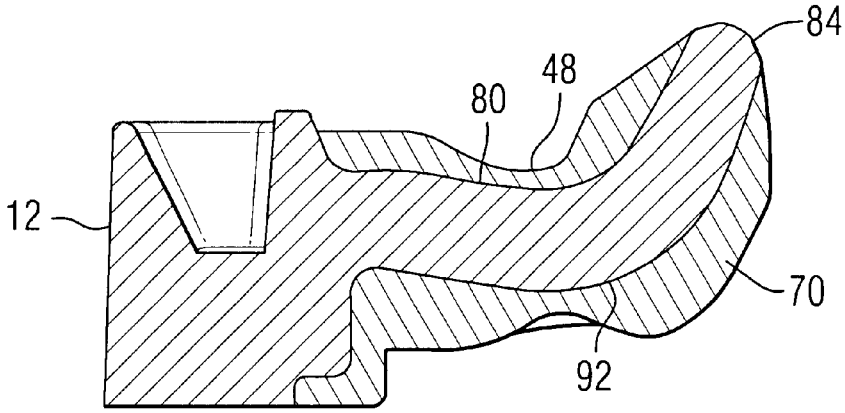
Figure 14:
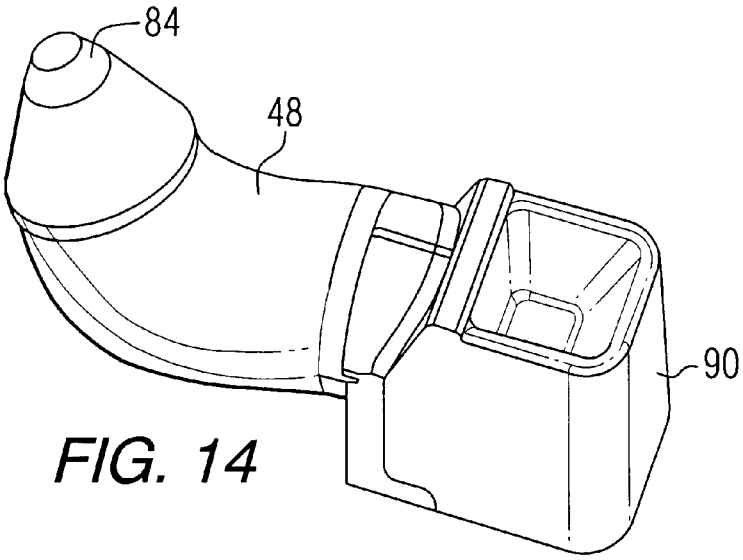

FIG. 12 is a composite core made in accordance with the present invention and having a soluble portion 70 formed around at least a portion of the insoluble support member 80 (not visible in FIG. 12) which has a distal end 84 extending from the soluble portion 70. FIG. 13 is a section view of FIG. 12 which more clearly shows the structural relationship between the insoluble support member 80 and the soluble portion 70. With particular reference to the region 48 in the central portion of the composite core, it can be seen that the strength provided by the strut 92 is important in assuring the structural integrity of the overall composite core. Regardless of how thin the mid portion 48 is, the metallic support strut 92 provides adequate support to prevent breakage and cracking in this region. FIG. 14 is an isometric view of the composite core made in accordance with the present invention, showing the distal end 84 extending from the soluble portion 48 which surrounds a metallic support strut 92 that extends from the base portion 90.

With reference to FIGS. 7–14, it can be seen that the distal end 84 of the support strut 92 provides a useful locating point that can be placed in direct contact with a metal portion of the injection die for the purpose of accurately and confidently locating the tip of the composite core in relation to the cavity of the die. Since the distal end 84 is metallic and its dimension can be relied upon, the present invention provides a useful locating tool that is unavailable with salt cores because of the dimensional uncertainty of certain salt surfaces.

Figure 15:
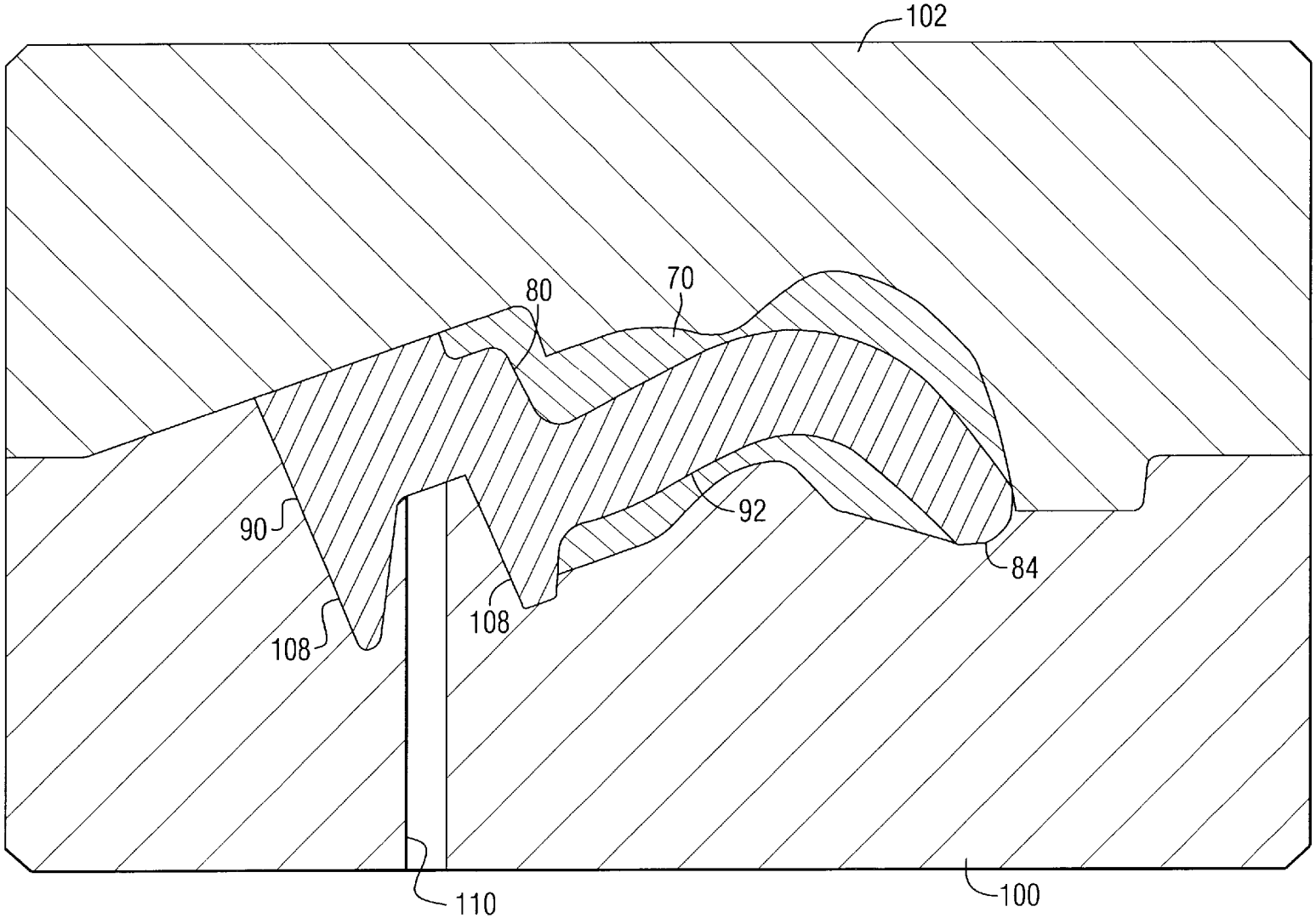
FIG. 15 shows a die used to manufacture a composite core of the present invention.

FIG. 15 shows a mold comprising a lower section 100 and an upper section 102. The mold, or die, is used to manufacture the composite cores of the present invention. The process for forming the composite cores comprises the steps of providing the mold or die (i.e. reference numerals 100 and 102), inserting the insoluble support member 80 into a locating portion of the die, identified by reference numeral 108, that is shaped to accurately hold the insoluble support member 80 in its proper place. The upper portion 102 of the die is then placed in location and molten salt is injected to form the soluble portion 70. After the soluble portion 70 solidifies around the support strut 92 of the insoluble support member 80, the upper 102 and lower 100 portions of the die are separated and the composite core is removed from the die. If necessary, an ejector pin can be inserted through hole 110 to separate the composite core from the lower portion 100 of the mold. As can be seen, when the insoluble support member 80 is placed into the lower portion of the die, the distal end 84 is placed in contact with the metal of the lower portion 100. Similarly, the base portion 90 is located in the portion 108 that is shaped to receive it. This accurately positions the insoluble support member 80 with respect to the lower portion 100 and causes the distal end 84 of the locating strut 92 to be exposed after the injected molten salt solution solidifies to form the soluble portion 70.

Figure 16:
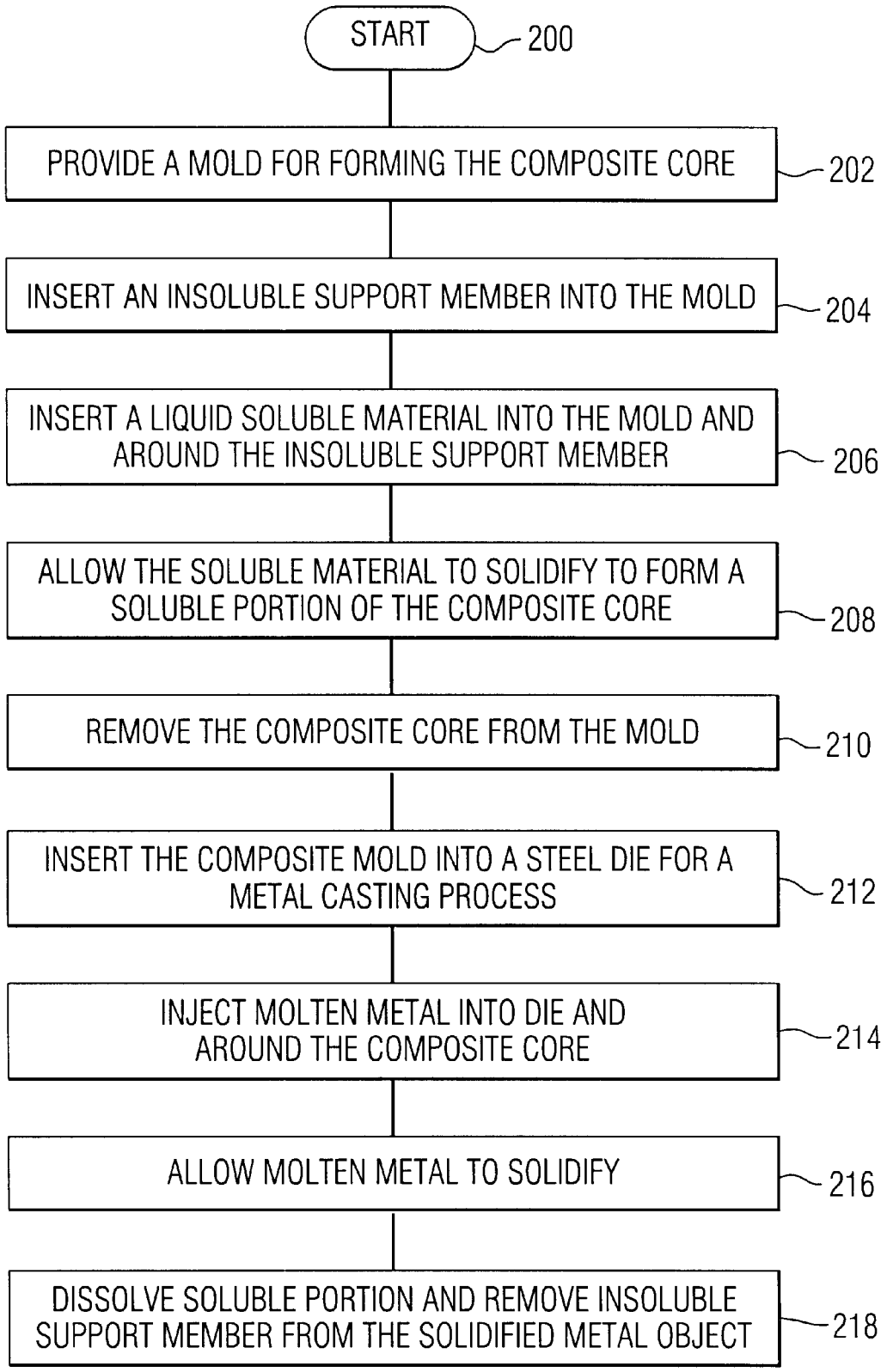
FIG. 16 is a block diagram of the process of forming the present invention and using the composite core to manufacture a metallic die cast part.

FIG. 16 shows the steps of the process of manufacturing a composite core of the present invention and using that composite core to form a cavity in a metal object by implementing a die casting procedure. The steps illustrated in FIG. 16 will be described in conjunction with FIGS. 1–15.

The method starts at functional block 200. The first step of the process is to provide a mold (e.g. reference numerals 100 and 102) for forming the composite core, as represented by functional block 202. The insoluble support member 80 is inserted into this mold as shown in functional block 204 and a liquid soluble material, such as salt, is injected into the mold and around the insoluble support member as described in functional block 206. The soluble material is then allowed to solidify around the insoluble support member 80 to form a soluble portion of the composite core. This is shown in functional block 208. The composite core is removed from the mold, as described in functional block 210 and inserted into a steel die 50 for a metal casting process. This is described in functional block 212. Molten metal is then injected into the die 50 and around the composite core as described in functional block 214, and the molten metal is allowed to solidify as described in functional block 216. After the molten metal is solidified, the metal object is removed from the die. Then, the soluble portion of the composite core is dissolved through the use of a liquid, such as water, and the insoluble support member 80 is removed from the solidified metal object, such as the cylinder head 10. This is described in functional block 218 in FIG. 16.

Although the present invention has been described in terms of a metallic support strut 92 used as insoluble support member, it should be understood that other configurations are also within the scope of the present invention. The preferred embodiment of the present invention, incorporates an aluminum support member 80, but other insoluble materials can also be used. Furthermore, in a preferred embodiment of the present invention, the soluble portion 70 of the composite core is made of salt. It should be understood that other soluble materials, as described above in relation to the United States patent in the prior art, can also be used. The soluble material can be disposed around the insoluble support member either by an injection molding process in which molten salt is injected into a die, a standard casting process, a pressing process, or a lost foam process in which molten salt is poured over a foam pattern supported by sand to dissolve the foam pattern and replace it with the molten salt material. The particular technique used to dispose the salt around the support member is not limiting to the present invention. The use of the insoluble support member 80 significantly reduces the amount of salt needed for the casting process since the insoluble support member 80 can be reused many times. This reduction in salt use is advantageous in two important ways. First, it decreases the cost of the casting process and, secondly, it benefits the environment by reducing salt consumption and the need to dispose large quantities of the used salt.

I claim:

1. A composite core for use in casting a metal object, comprising:

a soluble portion of said composite core having an outer surface shaped to form an internal surface of a cavity in said metal object; and an insoluble support member disposed within said soluble portion, said soluble portion being disposed around all portions of the surface of said insoluble support member which would otherwise be exposed to molten metal used to cast said metal object.

2. The composite core of claim 1, wherein:

said insoluble support member is made of metal.

3. The composite core of claim 1, wherein:

a distal end of said insoluble support member extends out of said soluble portion to expose said distal end.

4. The composite core of claim 1, wherein:

said insoluble support member comprises a metallic strut and a base portion from which said metallic strut extends.

5. The composite core of claim 4, wherein:

said base portion is shaped to be held by a mold.

6. The composite core of claim 1, wherein:

said soluble portion is made of salt.

7. A method for casting a metal object, comprising the steps of:

providing an insoluble support member;

forming a soluble portion around all portions of the surface of said insoluble support member which would otherwise be exposed to molten metal used to cast said metal object; and providing a shaped outer surface of said soluble portion to be generally identical to a cavity in said metal object.

8. The method of claim 7, further comprising:

extending a distal end of said insoluble support member out of said soluble portion.

9. The method of claim 7, further comprising:

disposing said insoluble support member in a mold having an internal surface which is shaped to form said metal object, said soluble portion being disposed at a location within said mold to create said cavity of said metal object and to prevent direct contact between said insoluble portion and said molten metal.

10. The method of claim 9, further comprising:

causing said molten metal to flow into said mold and around said insoluble support member with said soluble portion formed around at least a portion of said insoluble support member, said molten metal being prevented from directly contacting said insoluble portion by the presence of said soluble portion; and allowing said molten metal to solidify.

11. The method of claim 10, further comprising:

removing said metal object from said mold with said soluble portion formed around at least a portion of said insoluble support member remaining in place within said solidified metal object;

dissolving said soluble portion; and removing said insoluble support member from said cavity of said metal object.

12. The method of claim 9, wherein:

said distal end of said insoluble support member is disposed in contact with an internal surface of said mold to determine a position of said soluble portion within said mold.

13. A method for casting a metal object, comprising the steps of:

providing an insoluble support member, said insoluble support member comprising a metallic strut and a base portion from which said metallic strut extends;

forming a soluble portion around all portions of the outer surface of said insoluble support member which would otherwise be exposed to molten metal used to cast said metal object during a subsequent casting process; and providing a shaped outer surface of said soluble portion to be generally identical to a cavity in said metal object.

14. The method of claim 13, further comprising:

extending a distal end of said insoluble support member out of said soluble portion.

15. The method of claim 14, further comprising:

disposing said insoluble support member in a mold having an internal surface which is shaped to form said metal object, said soluble portion being disposed at a location within said mold to create said cavity of said metal object and to prevent direct contact between said insoluble portion and said molten metal, said distal end of said insoluble support member being disposed in contact with an internal surface of said mold to determine a position of said soluble portion within said mold.

16. The method of claim 15, further comprising:

causing said molten metal to flow into said mold in non contact relation with said insoluble support member with said soluble portion formed around at least a portion of said insoluble support member; and allowing said molten metal to solidify.

17. The method of claim 16, further comprising:

removing said metal object from said mold with said soluble portion formed around at least a portion of said insoluble support member remaining in place within said solidified metal object;

dissolving said soluble portion; and removing said insoluble support member from said cavity of said metal object.

18. The method of claim 13, wherein:

said soluble portion is made of salt.

* * * * *